US006068496A

United States Patent [19]

Penate

[11] Patent Number: 6,068,496

[45] Date of Patent: May 30, 2000

[54] SLIDING DOOR FOR A DOCK PORT

[75] Inventor: Ricardo A. Penate, Pacifica, Calif.

[73] Assignee: 3Com Corporation, Santa Clara, Calif.

[21] Appl. No.: 09/037,195

[22] Filed: Mar. 9, 1998

[51] Int. Cl.[7] ..... H01R 13/44

[52] U.S. Cl. ..... 439/140

[58] Field of Search ..... 439/140, 141, 439/136; 361/724, 725, 726, 727

[56] References Cited

U.S. PATENT DOCUMENTS

| | | | |
|---|---|---|---|
| 4,773,032 | 9/1988 | Uehara et al. | 439/138 |
| 4,843,226 | 6/1989 | Kato et al. | 439/140 |
| 5,035,633 | 7/1991 | Kobayashi et al. | 439/138 |
| 5,187,645 | 2/1993 | Spalding et al. | 361/393 |
| 5,222,907 | 6/1993 | Katabushi et al. | 439/140 |
| 5,224,869 | 7/1993 | Lee | 439/136 |
| 5,253,139 | 10/1993 | Satou | 439/136 |
| 5,323,291 | 6/1994 | Boyle et al. | 361/683 |
| 5,463,742 | 10/1995 | Kobayashi | 395/281 |
| 5,488,572 | 1/1996 | Belmont | 364/514 |
| 5,554,822 | 9/1996 | Gilpin et al. | 174/52.3 |
| 5,555,491 | 9/1996 | Tao | 361/686 |
| 5,559,672 | 9/1996 | Buras, Jr. et al. | 361/684 |
| 5,598,539 | 1/1997 | Gephardt et al. | 395/281 |
| 5,632,020 | 5/1997 | Gephardt et al. | 395/283 |
| 5,644,471 | 7/1997 | Schultz et al. | 361/686 |
| 5,687,060 | 11/1997 | Ruch et al. | 361/686 |
| 5,701,232 | 12/1997 | Tang et al. | 361/683 |

*Primary Examiner*—Renee S. Luebke
*Assistant Examiner*—T. C. Patel
*Attorney, Agent, or Firm*—Wilson Sonsini Goodrich & Rosati

[57] ABSTRACT

A sliding door mechanism for a portable communication or data processing device is adapted for placement of the device on a docking port. The portable device has a component that is covered by the sliding door when the door is in a closed position. A single wire spring coupled with the door and the device has a spring force tending to keep the door closed. The door opens in response to placement of the device on the docking port rail. Upon placement of the device on the docking port rail, the docking port rail slides into guides on a door receptacle located on the housing of the device. The rails of the door in the closed position are slidably disposed in the door receptacle guides. The weight of the device causes the door receptacle guides to cover the docking port rail. As the door receptacle guides slide onto the docking port rail, the door rail is moved upwards into the device, the spring is compressed and the door opens. When the door is in the open position, the docking port connector is in contact with a device component so that the device can communicate through the docking port to other data processing and communication devices. Also, because of the weight of the device supported by the docking port, and the spring force, the device connection to the docking port has very little wobble.

4 Claims, 11 Drawing Sheets

SLIDING DOOR FOR A DOCK PORT

BACKGROUND OF THE INVENTION

1. Field of Invention

The present invention relates to a sliding door mechanism, and more specifically to a sliding door mechanism for a dock port 2. Description of Related Art The use and advantages of portable electronic devices are well known in the art. Over the last decade there has been a tremendous effort to decrease the size of electronic devices. This effort has been particularly intense for computing and communication devices to provide users with tools that are easily kept with the user at all times. The movement has been from the desktop to the laptop and from the laptop to the notebook. While various notebook styles and sizes are available, the trend appears to be towards devices that may be carried in a user's pocket and operated in a user's palm, known as handheld devices.

In order to provide useful applications in the size driven handheld devices, many design, processing and space saving changes occurred in the device electronics and in the exterior device design. User expectations have grown with the handheld device technology developments, especially in terms of processing capacity and interface capability. To provide sufficient capability in the portable computers various means have been developed to allow a user to temporarily expand notebook computer capabilities by connecting the portable computer to a desktop computer and to the network associated with that desktop computer.

To connect the portable computers to the desktop and network resources, internal ports are provided for the portable computer. These internal device ports typically communicate with the desktop and network resources through a docking port. However, due to restricted space requirements for the notebook devices, many designs do not provide for a covering of the opening associated with the internal port. This allows debris to enter the portable device's electronics, and subjects the electronics to greater corrosion and electrostatic discharge failure rates.

To overcome these problems, several manufacturers provide a hinged door that opens outwardly from the portable device and covers the opening when in a closed position. However, because the doors extend outwardly beyond the rest of the portable device, the doors are particularly susceptible to breaking when in the open position, and can interfere with easy insertion of the portable device into the desired docking port. Portable device doors have heretofore addressed electrical contact access, but have not provided means for simple user connection to a docking port that is relatively free from open position breakage failures.

Therefore, it is readily seen that there is a need in the art for a mechanism that effectively covers a portable device opening, provides for easy, reliable, and wobble-free docking of the portable device to a docking port, and requires a minimum of additional space within the device.

SUMMARY OF THE INVENTION

The present invention provides a sliding door mechanism for covering an opening in a portable device. For example, in a typical portable device, the present invention provides for a spring actuated sliding door that covers a component of the device when the door is closed and permits connection of the device component to a docking port when the door is opened.

Thus, a sliding door mechanism for a device adapted for placement on a docking port is provided where the device has a weight and includes a device housing and a component. The docking port includes a connector for establishing data communications with the component. The sliding door mechanism comprises a door receptacle, a door, and a spring. The door receptacle is disposed on the device housing and has a bottom and a top. The door has a closed position wherein the door covers the component of the device, and an open position wherein the door is displaced from the closed position towards the top of the door receptacle. The door in the open position provides sufficient clearance for placement of the device on the docking port and establishment of data communications through the docking port connector. The spring is coupled with the door and the device, and has a spring force tending to keep the door in the closed position. The spring force also permits the door to move to the open position in response to placement of the device on the docking port; so that the component of the device establishes data communications through the connector of the docking port in response to the weight of the device.

According to one implementation of the sliding door mechanism, the device component comprises an electrical contact through which data communications with the docking port connector are made, and an electrical connection between the device electrical contact and the docking port connector is maintained by the portion of the weight of the device supported by the docking port connector.

In other implementations of the sliding door mechanism, the door receptacle flier comprises a plurality of guides. Each of the guides extends between the bottom and the top of the door receptacle. The door further comprises a plurality of rails fitting in the plurality of guides.

According to one aspect of the invention, the door further comprises a plurality of rails. The rails lie in a first plane and the first plane is the plane of the door. The spring is a single wire and lies in a substantially planar region. The substantially planar region is adjacent and parallel to the first plane so that the combined thickness of the door, and the spring is less than two centimeters, and therefore the sliding door mechanism is adapted for a flat compact device. In some implementations of this aspect of the invention, the door receptacle lies in the third plane. The third plane is parallel to the first plane so that the combined thickness of the door, the door receptacle and the spring is less than four centimeters.

According to another implementation of the sliding door mechanism the device component comprises a serial port having a plurality of pins. The device component can also comprise a synchronous RS232 serial port.

According to another aspect of the invention, the door receptacle has two sides and each side includes a guide. The door has a bottom and a top. The open position has the bottom of the door displaced from the closed position towards the top of the door receptacle with a portion of the door fitting underneath the housing. The door farther comprises two sides. Each side of the door has a rail extending into a corresponding guide on a side of the door receptacle. Each rail is adapted for sliding in the corresponding guide.

According to another implementation of the sliding door mechanism, the door receptacle has two sides and the door has two sides. The two sides of the door receptacle, and the two sides of the door are centrally disposed within the housing so that the spring force is exerted in a top to bottom direction, exerting minimal force to either side of the door receptacle.

According to another aspect of the invention, the spring has a bottom and a top and further comprises two spring guides disposed between the top of the spring and the bottom of the spring. The spring guides keep the door from moving sideways beyond the spring guides.

According to another implementation of the sliding door mechanism the device housing has a front, a back, and two sides. The door receptacle has two sides and the top of the door receptacle has a width greater than the door. The door receptacle further comprises a plurality of attachment stakes disposed near the top of the door receptacle and between a side of the door and a corresponding side of the door receptacle. Each of the attachment stakes extends from the back housing towards the front housing. The spring has a top and a bottom. The spring further comprises a plurality of attachment loops and two spring guides. The attachment loops are disposed between the bottom of the spring and the top of the spring. Each of the attachment loops fits around the outside of the corresponding attachment stake. The two spring guides are located between the top of the spring and the bottom of the spring. The spring guides keep the door from moving sideways beyond the spring guides. Each of the spring guides extends between a corresponding spring attachment loop and the top of the spring.

According to another aspect of the invention, the spring has a top and a bottom. The door receptacle has two sides and fierier comprises a centrally disposed element and a plurality of stops. The centrally disposed element is located between the two sides and has a lower edge disposed above the bottom of the door receptacle. The plurality of stops are located on an interior surface of the centrally disposed element of the door receptacle. Each of the stops is disposed along the top of the door receptacle and extends from the top of the door receptacle towards the bottom of the door receptacle. At least one of the stops is in contact with and disposed below the top of the spring, thereby maintaining a gap between the spring and the interior surface of the centrally disposed element and preventing the door from wedging against the door receptacle.

Alternatively, the present invention can be characterized as a portable device adapted for placement on a docking port, the portable device having a weight and including a device housing and a component The docking port includes a connector for establishing data communications with the component The portable device has a plurality of applications. Each application is capable of operating independently from the data connection to the docking port Nonetheless, data can be transmitted to selected applications in the device from a second device through data communications between the docking port connector and the device component. The device component is adapted to transmit data from the portable device applications to the docking port for processing in the second device. The second device can be a desktop computer, a portable computer, a network, or any other compatible data processing device. The component is also adapted to receive data from the docking port for storage and processing in the portable device applications. The present invention encompasses such a device with any of the characteristics, features and limitations described above for the sliding door mechanism embodiments, implementations, and aspects.

The present invention is also provided as a system for communicating data comprising a docking port and a portable device. The docking port comprises a connector, and the connector has an electrical contact. The portable device is adapted for placement on the docking port and has a weight The portable device also has a component adapted for communicating through the docking port connector. The docking port and the device are canted at an angle from vertical in a range from ten degrees to eighty degrees, and electrical connection between the device component and the docking port connector is maintained by the portion of the weight of the device supported by the electrical contact. According to one aspect of the invention, the portion of the device weight supported by docking port electrical contact is less than forty percent (40%) of the device weight.

According to one implementation of the invention, the portable device has a housing and further comprises a door receptacle, a door, and a spring. The door receptacle is disposed on the device housing. The door receptacle has a bottom, a top and two sides. Each side has a guide.

The door has a closed position wherein the door covers the component of the device, and an open position wherein the door is displaced from the closed position towards the top of the door receptacle. In the open position, the door provides sufficient clearance for placement of the device on the docking port and establishment of the data communications through the docking port connector. The spring is coupled with the door and the device. The spring has a spring force tending to keep the door in the closed position, and permits the door to move to the open position in response to placement of the device on the docking port; so that the component of the device establishes data communications through the docking port connector in response to the weight of the device. The docking port connector further comprises a rail adapted for insertion into the door receptacle guides so that the portion of the device weight supported by the docking port rail and the spring is greater than sixty percent (60%) of the device weight.

Other aspects of the invention can be seen upon review of the drawings, the detailed description and the claims which follow.

DETAILED DESCRIPTION OF THE PREFERRED EMBODIMENT

Figure 1:
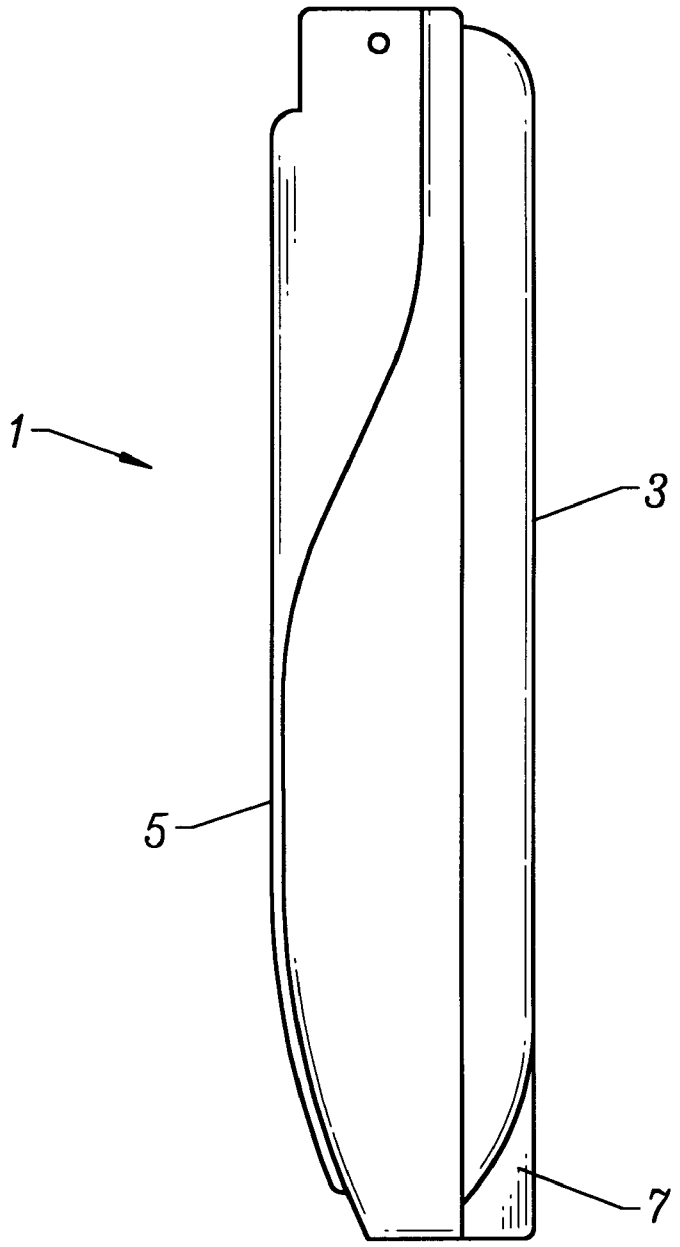
FIG. 1 is a side view of the device.
Figure 2:
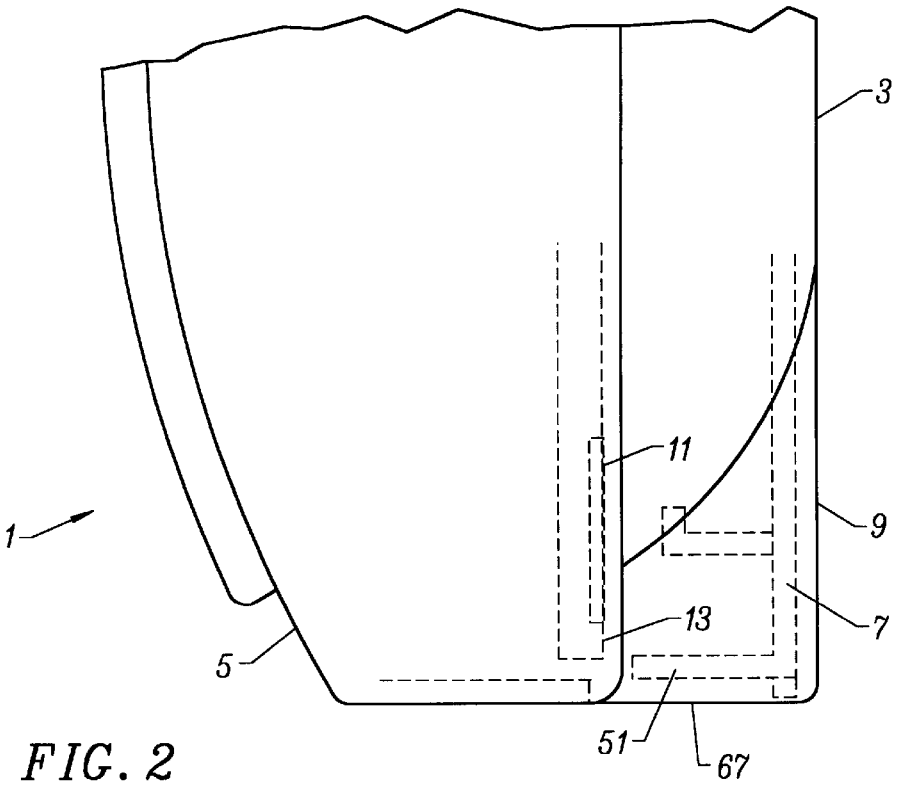
FIG. 2 is a cross section view of the bottom of the device showing among other device features: the door, the bottom of the door, the component, the door receptacle, the bottom of the door receptacle, the front housing, and the back housing. The door is in the closed position in FIG. 2.
Figure 3:
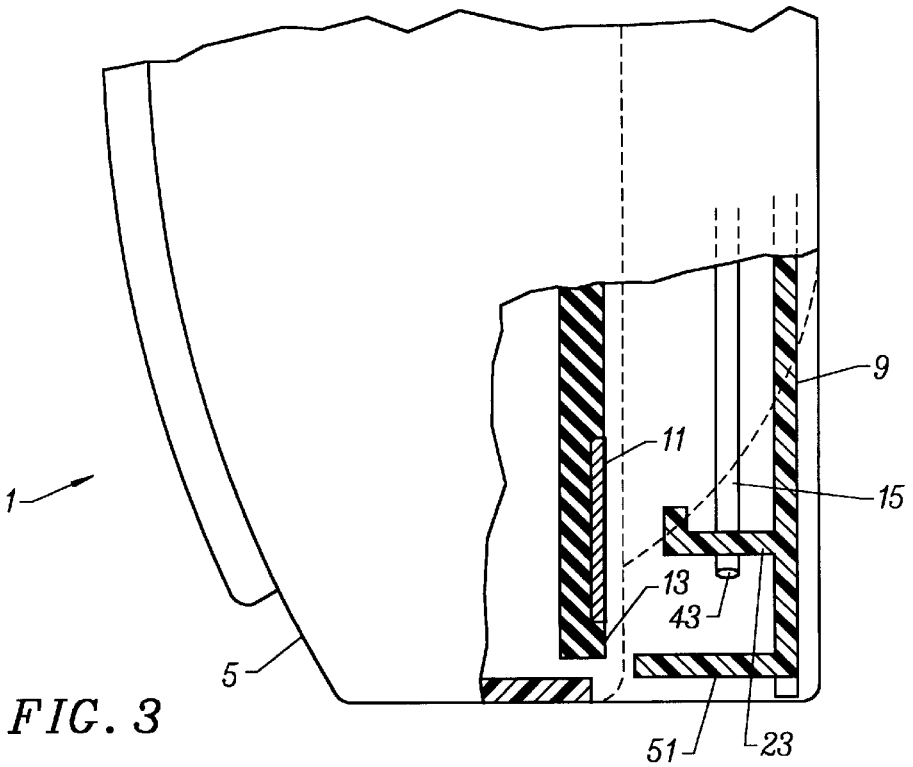
FIG. 3 is a cross section view of the bottom of the device with the door receptacle removed in order to more clearly reveal the details of the door and the spring. The door is in the closed position in FIG. 3.
Figure 4:
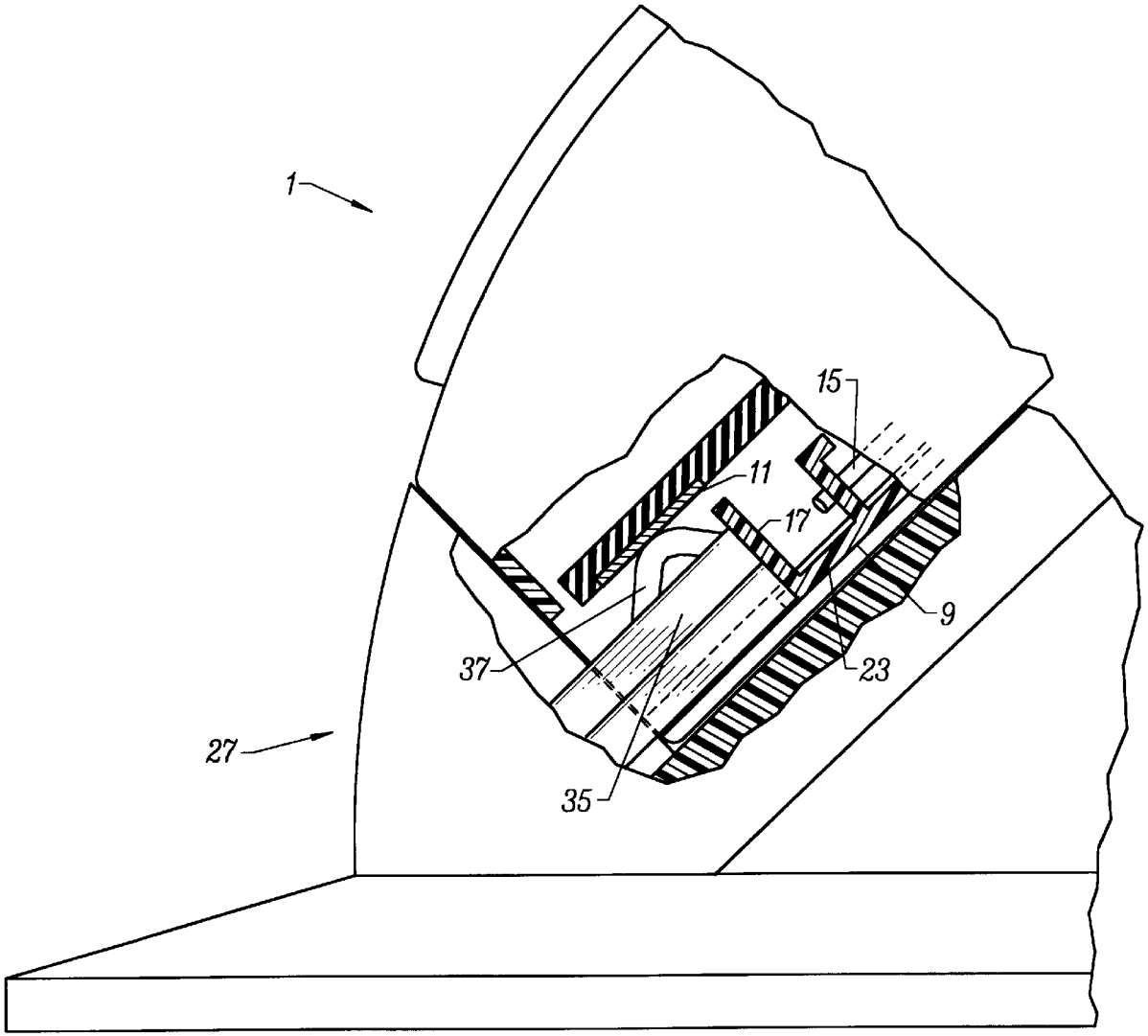
FIG. 4 is a cross section view of the bottom of the device and the docking port with the door receptacle removed. The door is in the open position in FIG. 4 and the device is connected with the docking port.
Figure 5:
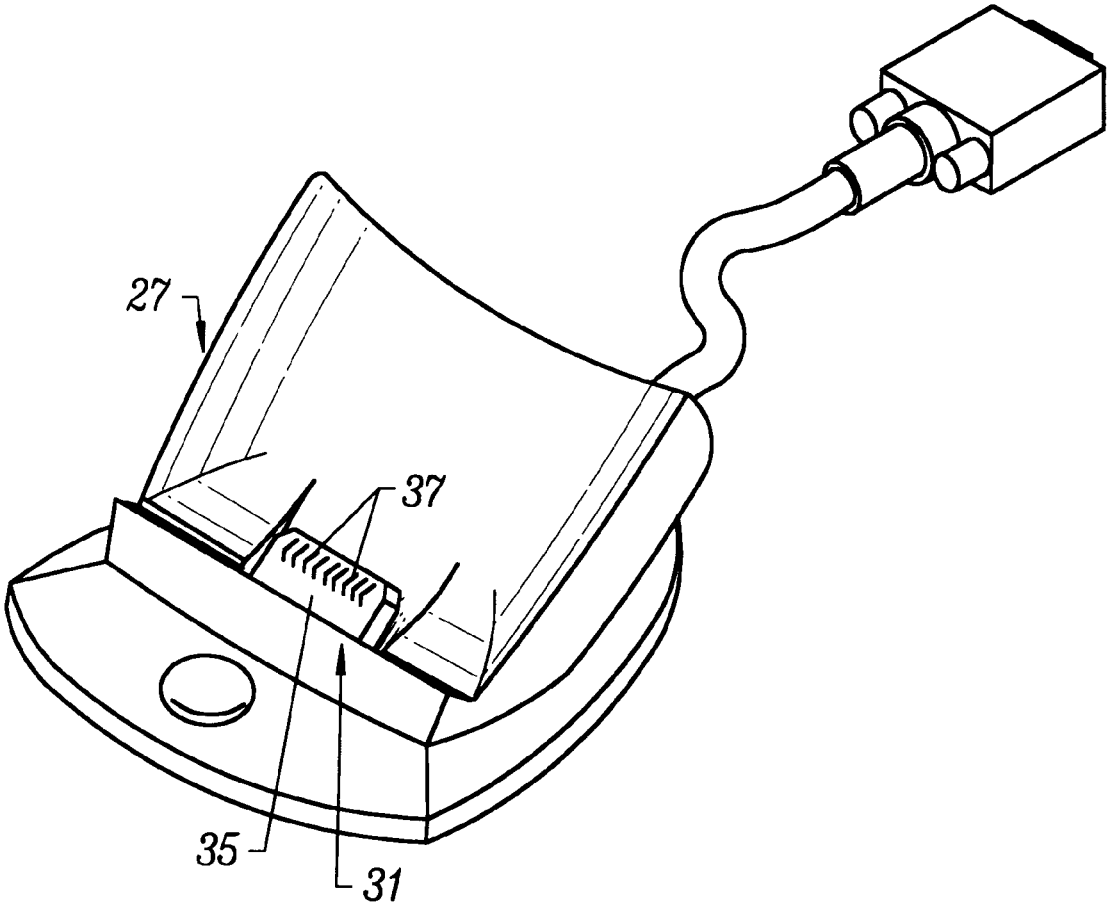
FIG. 5 is a perspective view of the docking port showing among other docking port features: the docking port rail and the docking port electrical contact.

A detailed description of the preferred embodiments of the present invention is provided with respect to FIGS. 1–13. FIGS. 1–3 illustrate the device and the basic elements of the sliding door mechanism associated with the device: the door, the door receptacle and the spring. FIG. 4 illustrates the mating of the device with the docking port. FIG. 5 illustrates the docking port and its key features. FIGS. 6–10 illustrate the key detailed elements of the sliding door mechanism located within the device. FIGS. 11 and 12 illustrate details of the wire spring. FIG. 13 is a perspective view of the door.

I. Sliding Door Mechanism-Basic Device Elements

The basic elements of the device sliding door mechanism associated with the device; the door, the door receptacle and the spring; are illustrated in FIGS. 1–3. In FIG. 1, a side view of the device 1 shows that the device comprises a back housing 3 and a front housing 5. The door receptacle 7 is shown on the back housing. The device has a weight.

In FIG. 2, a side view cross section of the bottom of the device shows the back housing 3, and the front housing 5. The door receptacle 7 is centrally disposed at the bottom of the back housing and forms a portion of the back housing exterior. With the exception of the door receptacle and a lower ledge 13, the back housing tapers inwards towards the bottom of the device. The door 9 is shown in the closed position and the top portion of the door is disposed inside the door receptacle. The bottom of the door does not extend as low as the bottom of the door receptacle 67. The device component 11 is disposed further inside the device housing than the door and is also disposed higher than the bottom of the door when the door is in the closed position. Therefore, the device component is covered by the door when the door is in a closed position. The device component is disposed on the lower ledge of the back housing and faces outward from the lower ledge. The device component can be any electrical contact. In the preferred embodiment, the device component comprises a serial port having plurality of pins, and more specifically a synchronous RS232 serial port. As shown in FIGS. 3 and 13, in the preferred embodiment, the door extension 51 is disposed near the bottom of the door and extends from the internal door surface (parallel to both of the door rails 20 and the spring 15) towards the front housing 5. The door extension ends very near the lower ledge of the back housing. FIG. 2 shows that, in the preferred embodiment, the primary external surfaces of the door and the door receptacle are parallel to a plane that is defined by a line at the front of the device from the top of the device to the bottom of the device and another line at the front of the device from one side of the device to the other side of the device. This plane is referred to as the plane of the device or the device plane. The primary external surfaces of the back housing and the front housing are also parallel to the device plane.

In FIG. 3, another side view of the bottom of the device 1 shows the sliding door mechanism without the door receptacle. In the preferred embodiment, the spring 15 lies in a substantially planar region that is parallel to the external surfaces of the device, the door 9, and the door receptacle. The placement of all the key elements of the sliding door mechanism in parallel planes provides for a flat and compact device because the combined thickness of the door, the door enclosure, and the spring is less than four centimeters. The spring retaining element 23 is adapted to contact crossing segments of the spring. The spring 15 extends below the spring retaining element Referring to FIGS. 3, 7 and 13, the bottom of the door 17 is lower than the bottom of the spring 43. The spring retaining element 23 is disposed on the door between the top 21 and the bottom of the door. The spring retaining element is centrally disposed on the door. In the preferred embodiment and as shown in FIG. 13, the spring retaining element has a width that is smaller than the door 9 width. A portion of the spring retaining element extends internally inside the back housing 3 from the door towards the back housing lower ledge 13. In the preferred embodiment, the portion of the spring retaining element referred to above is the first portion. The second portion of the spring retaining element is located at the most inward edge of the first portion and extends towards the top of the device. This second portion is adapted to keep the bottom of the spring 43 from angling forward or backward towards the housing lower ledge and the device component 11.

II. Docking Port and Connection of Device to the Docking Port

The docking port 27 and the connection of the device 1 to the docking port are illustrated in FIGS. 4 and 5. One embodiment of the invention is a system for data communication comprising the portable device and the docking port. In FIG. 4, a side view cross section shows the bottom of the device and the docking port. The door 9 is in the open position and the device is connected to the docking port. As in FIG. 3, the door receptacle is not shown in order to more clearly show the interaction of the door with the docking port and the spring 15. FIG. 4 shows the docking port rail 35 in contact with the bottom of the door 17. The docking port electrical contacts 37 are in contact with the device component 11.

In the preferred embodiment, the device 1 is a handheld portable device with communications and/or data processing capability. The present invention device is adapted to operate a plurality of applications. Each application is capable of operating independently from the docking port connector 31. Data can be transmitted to selected applications in the present invention device from a second device through data communications between the docking port connector and the device component. The second device is typically a communications and/or data processing device and can be a network server, a desktop computer, another handheld device, or any other communications and/or data processing device known in the art. The device component 11 is adapted to transmit data from the present invention device applications to the docking port 27 for processing in the second device, and to receive data from the docking port, and other devices attached to the docking port, for storage and processing in the present invention portable device applications.

Note that FIG. 4 is a greatly simplified representation of the actual docking port 27 and the device 1. In the preferred embodiment, the device and docking port are canted so that the top of the device does not extend in a fully vertical manner from the bottom of the device. The docking port electrical contact 37 and device component are also canted at an angle from vertical. The angle from vertical is in a range from one degree to eighty-nine degrees. The preferred embodiment has a device angle from vertical in a range from ten degrees to forty-five degrees. The angle from vertical enables the docking port electrical contact to support a portion of the device weight, thereby ensuring that electrical contact is maintained between the device and the docking port In the preferred embodiment, the portion of the weight supported by the docking port electrical contact is less than forty percent (40%) of the device weight. The portion of the weight of the device that is not supported by the docking port electrical contact is supported by the docking port rail 35 and the spring 15.

In FIG. 5, a perspective view of the docking port shows the angle from vertical of the docking port. In the preferred embodiment, the docking port electrical contact 37 comprises a plurality of parallel electrically conductive pads longitudinally aligned with the top to bottom direction of the device. The device component 11 also comprises a plurality of parallel electrically conductive pads longitudinally aligned with the top to bottom direction of the device. The conductive pads of the component and the electrical contact are disposed so that the conductive pads of the component and the electrical contact are touching when the device is properly placed on the docking port. The docking port rail is clearly seen to be adapted to slide in the door receptacle guide 71 in response to placing the weight of the device on the docking port 27. As the docking port rail slides in the door receptacle guide, the spring is compressed and the door 9 slides upward in the door receptacle guide. The mechanical connection of the device to the docking port is such that the docking port experiences very little wobble because of the sliding of the docking port rail in the door receptacle and the angle from vertical of the device and docking port.

III. Sliding Door Mechanism: Detailed Device Elements

Figure 6:
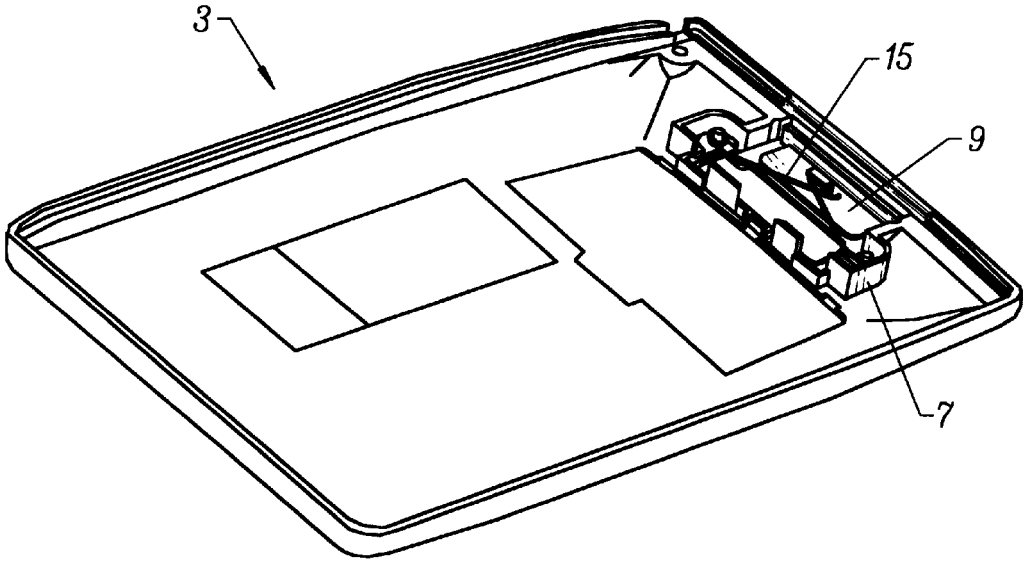
FIG. 6 is a perspective view of the interior of the device back housing, illustrating the door, spring, and door receptacle.
Figure 8:
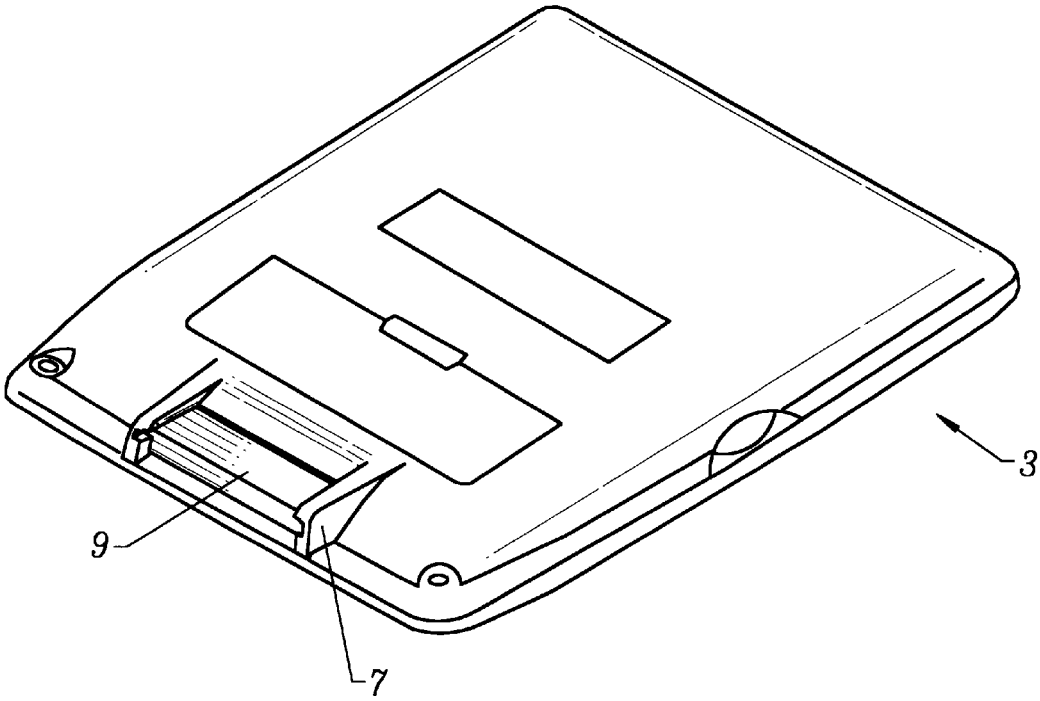
FIG. 8 is a perspective view of the exterior of the device back housing, the door, and door receptacle.
Figure 7:
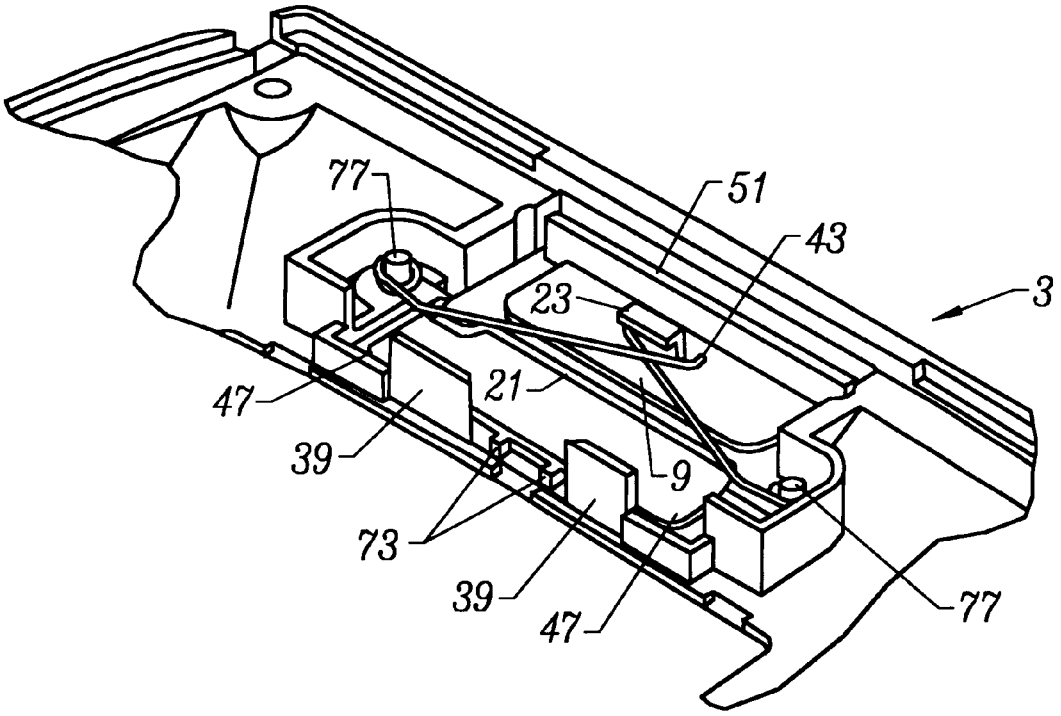
FIG. 7 is an exploded view of the back housing interior shown in FIG. 6. Among other aspects of the present invention, FIG. 7 reveals the interaction of the spring with the spring retaining element, and the interaction between the attachment loops and the attachment stakes.
Figure 9:
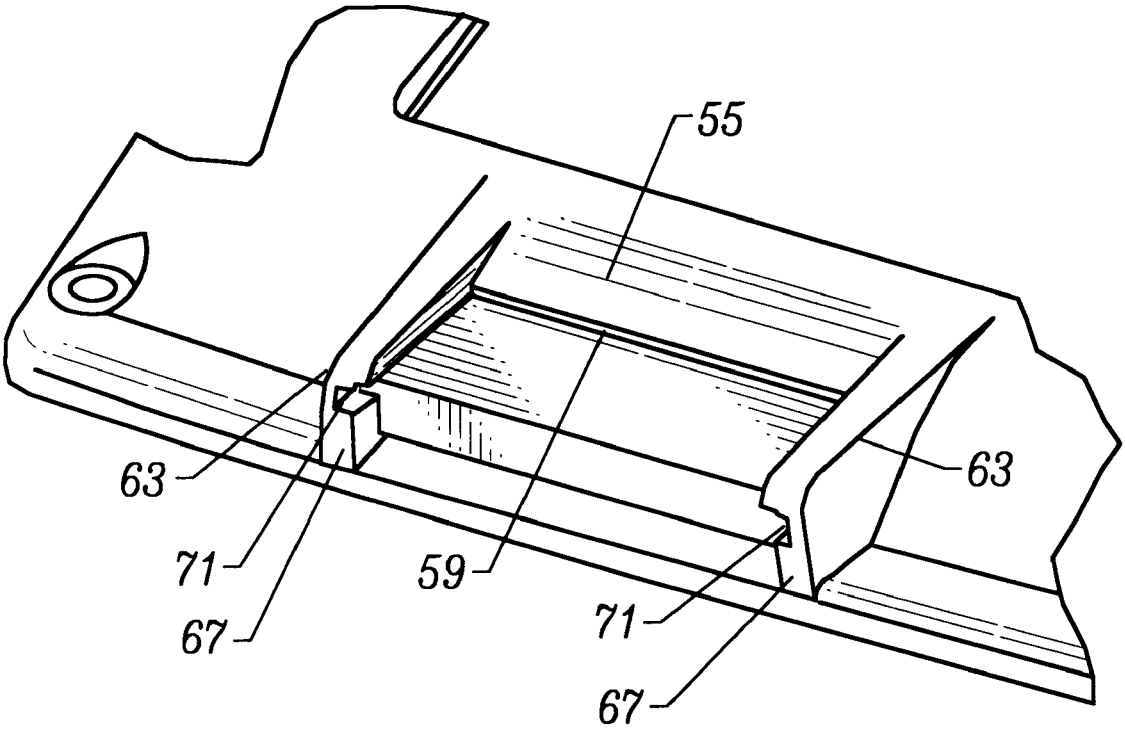
FIG. 9 is an exploded view of the exterior of the device back housing shown in FIG. 8. Among other aspects of the present invention, FIG. 9 reveals the door receptacle guides and the door receptacle centrally disposed element.

Several key detailed elements of the sliding door mechanism located within the device are illustrated in FIGS. 6–12. FIGS. 6–7 are perspective views of the interior of the device back housing 3. FIGS. 8–9 are perspective views of the exterior of the device back housing. FIGS. 8–9 show the door receptacle 7 disposed on a device back housing. The sliding door mechanism is adapted for placement on the docking port 27 and comprises a door receptacle, a door 9, and a spring 15. As shown in FIG. 9, the door receptacle has a bottom 67 and two sides 63. As shown in FIG. 8, the door receptacle has a top 39. In the absence of any other device feature such as the door, the door receptacle exposes the device component 11. The door can be in a closed position wherein the door covers the device component, in an open position wherein the door is displaced from the closed position towards the top of the door receptacle wherein the device component is exposed, or in positions intermediary between the open and closed positions. In the open position, the door provides sufficient clearance from the docking port to provide for unobstructed placement of the device on the docking port.

As shown in FIG. 7, the spring 15 is coupled with the door 9 and the device 1. The spring tends to keep the door closed, but also permits the door to open in response to placement of the device on the docking port 27. The door opens in response to the weight of the device as the device is placed on the docking rail 35, and the door receptacle 7 slides over the docking port rail. When the door is in the open position the device is able to establish data communications through the docking port connector 31.

As shown in FIG. 13, the door 9 has two sides 19. The two sides of the door receptacle 63 and the two sides of the door are centrally disposed within the back housing 3 so that the spring force is exerted in a top to bottom direction exerting minimal force to either side of the door receptacle. FIG. 7 shows the door rails 20 which are pressed upwards by the docking port rail 35 when the device 1 is placed on the docking port 27. As the door moves upwards, the spring retaining element 23 exerts a compressive force upwards on the spring 15. The spring moves upwards in response to this force permitting the door to move upward and thereby open. As the docking port rails slide into the bottom of door receptacle guides 71, they push the door rails further towards the top of the door receptacle 39. When the top of the door rails extend beyond the top of the door receptacle guides, the spring guides 47 ensure that the door rails do not move sideways within the door enclosure.

The spring 15 has a bottom 43 in contact with the door spring retaining element 23. In the preferred embodiment, the bottom of the door 17 comprises a line with a midpoint. The bottom of the spring is located between the bottom of the door and the top of the door 21. As shown in FIGS. 7, 11A, 11B, and 12 the bottom of the spring 43 has two bottom points equidistantly disposed from the midpoint of the bottom of the door. In the preferred embodiment, the separation of the two bottom points of the spring bottom feature is in a range from 0.5 mm to 50.0 mm. The bottom of the spring also has a first crossing segment 81 and a second crossing segment 85. Each of the crossing segments extends from the corresponding spring bottom point towards the top of the door 21 and also towards the corresponding side 63 of the door receptacle. The first crossing segment is disposed above the second crossing segment at a crossing point 89. The crossing point 89 is closer to the top of the door than is the spring retaining element 23. Each of the crossing segments is in contact with the spring retaining element at a location along the corresponding crossing segment Each point of contact is closer to the bottom of the door than is the crossing point. The spring retaining element and the crossing point are centrally disposed within the back housing further reinforcing the top to bottom direction of the spring force.

Figure 10:
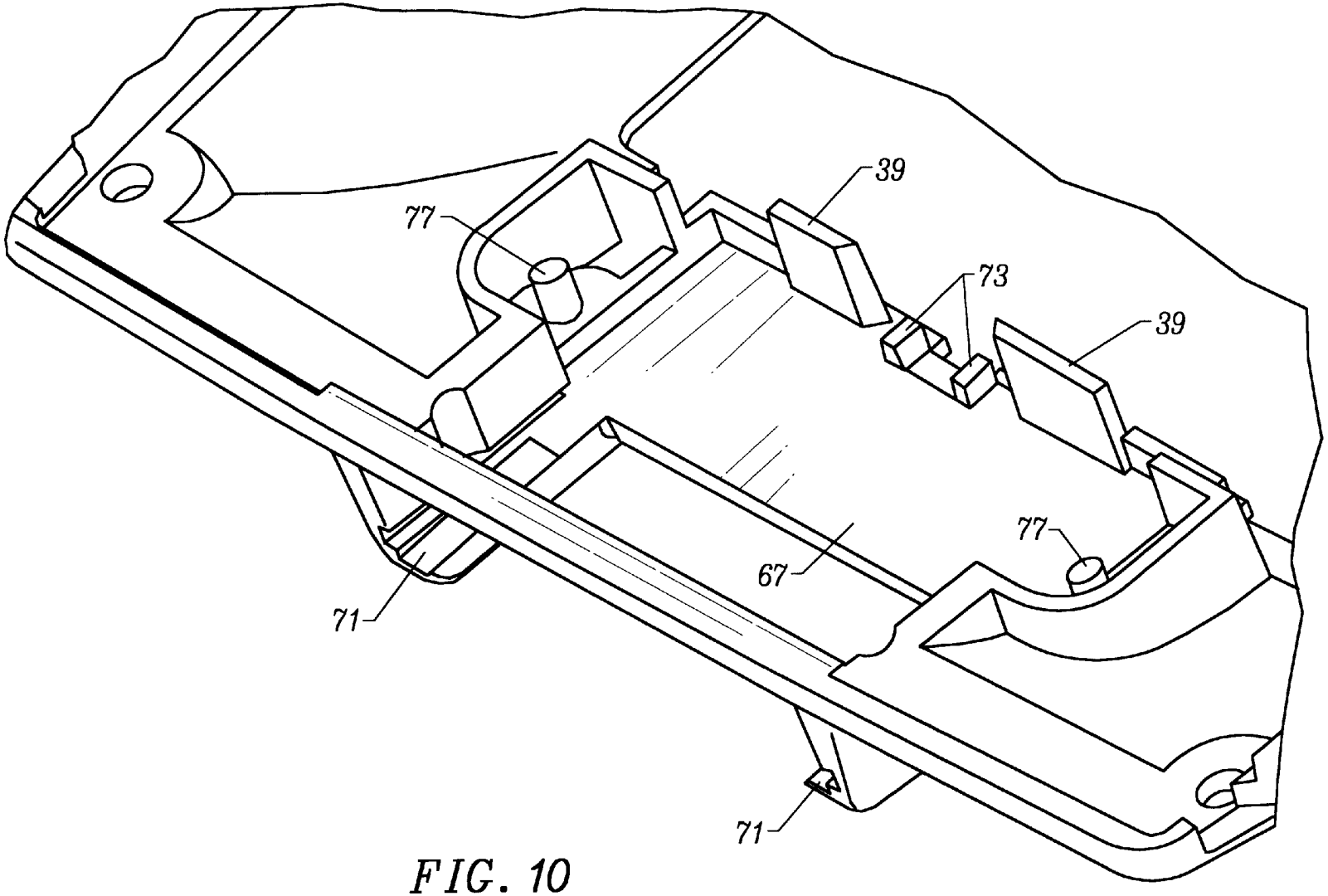
FIG. 10 is another exploded view of the back housing interior revealing, among other aspects of the present invention: the attachment stakes, the stops, and a more complete view of the door receptacle guides.

As shown in FIG. 10, the door receptacle 7 has a plurality of receptacle guides 71. The door receptacle guides extend between the bottom 67 and the top 39 of the door receptacle. The door 9 has a plurality of rails 20, and each rail fits into a corresponding door receptacle guide. In the preferred embodiment, as shown in FIG. 13, the door has a bottom 17, a top 21, and two sides 19. Each side of the door has a rail. As shown in FIG. 9, when the door is in the open position, the door bottom moves from its closed position towards the top of the door receptacle and the door fits underneath the centrally disposed element 55 of the door receptacle. Each of the rails extends into a corresponding door receptacle guide, and each of the rails is adapted for sliding in the corresponding door receptacle guide. The parallelism of the critical sliding door mechanism components is also illustrated by FIG. 7. The rails lie in a first plane which is the plane of the door.

The back housing 3 has two sides, and the front housing 5 has two sides. As shown in FIG. 10, the door receptacle 7 further comprises a plurality of attachment stakes 77 disposed near the top of the door receptacle 39. The top of the door receptacle is wider than the door 9. Each of the attachment stakes extends from the back housing towards the front housing and each of the attachment stakes is closer to the corresponding device side than is the corresponding side of the door 19.

Figure 11A:
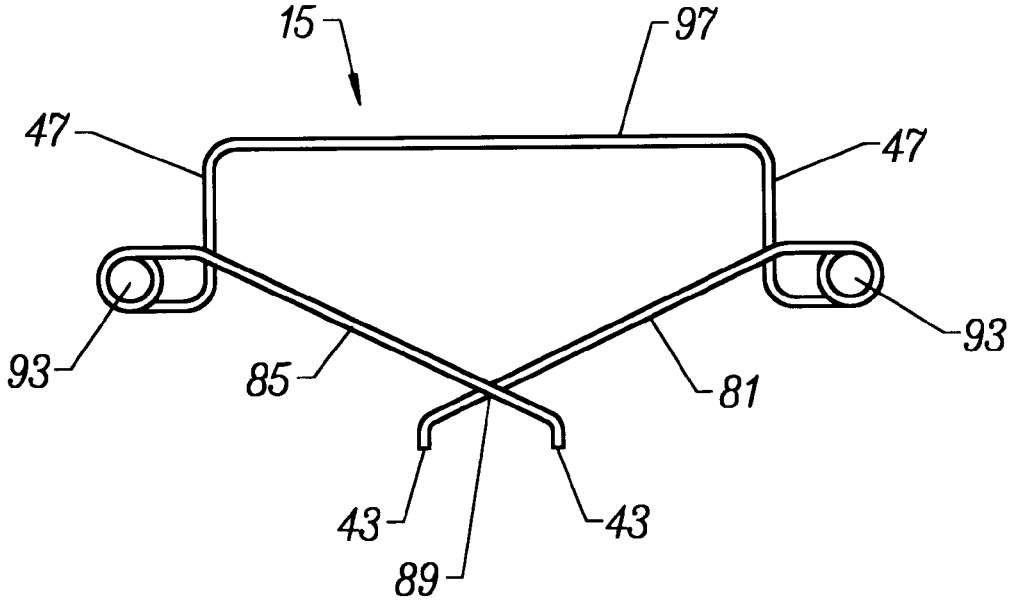
FIG. 11A illustrates aback view of the spring and FIG. 11B illustrates a bottom view of the spring.
Figure 11B:
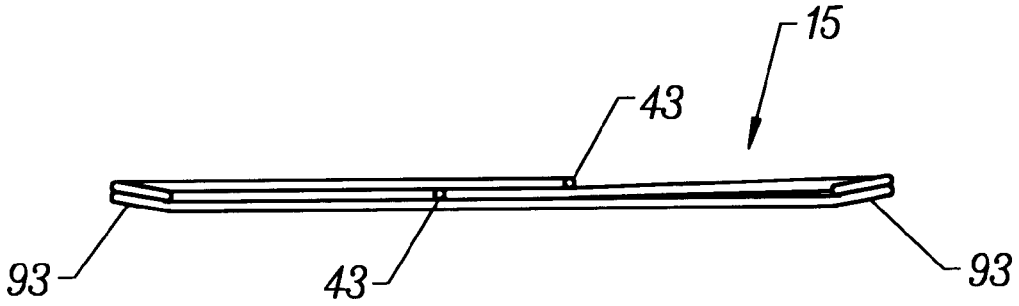
Figure 12:
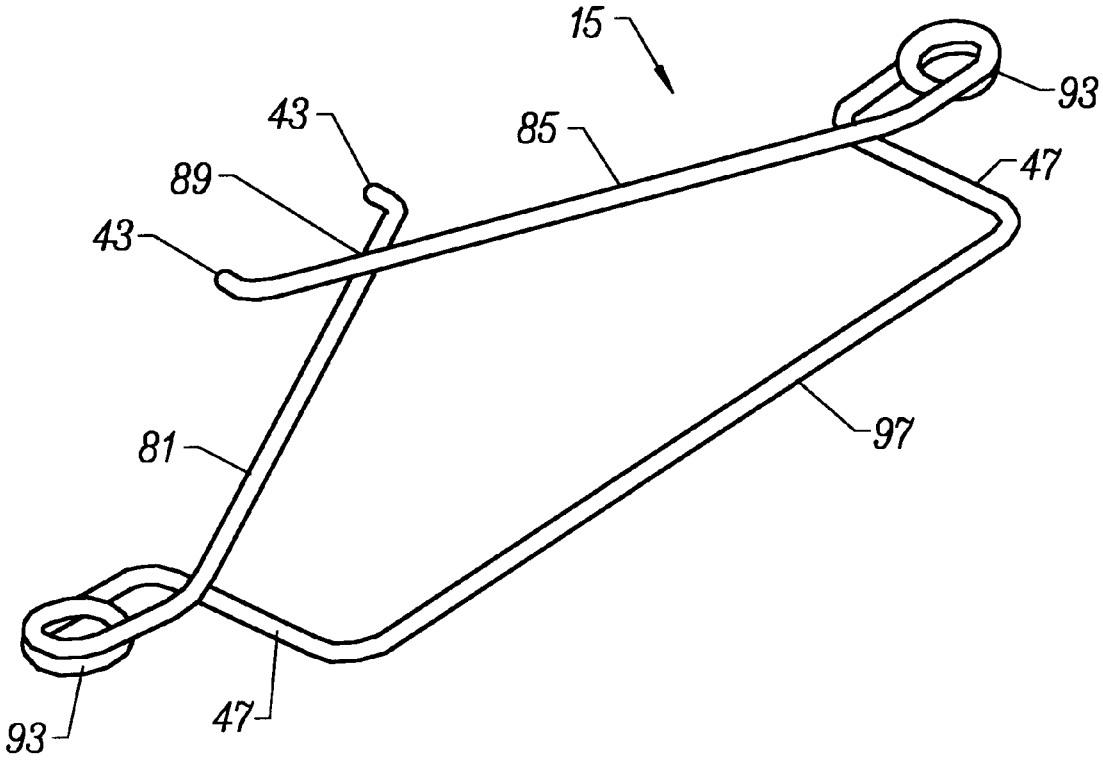
FIG. 12 is a perspective view of the spring.
Figure 13:
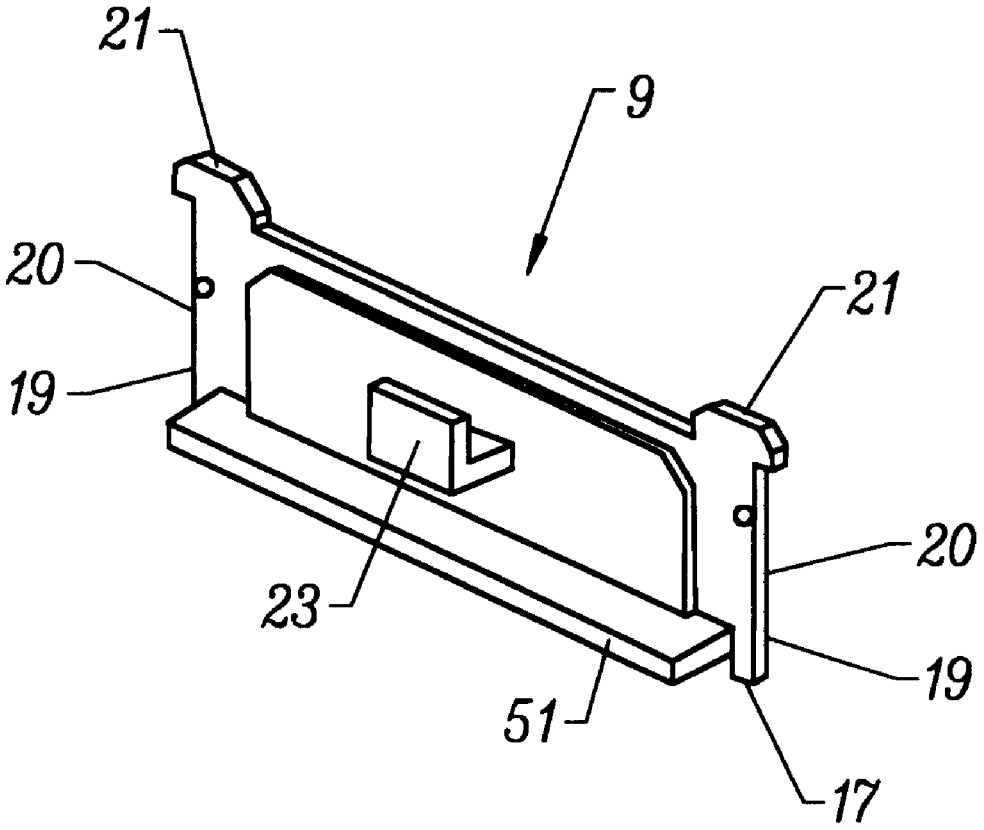
FIG. 13 is a perspective view of the door.

As shown in FIGS. 11A, 11B and 12, the spring 15 has a bottom 43 and a top 97. The top comprises a straight segment having a portion of its length in contact with the top of the door receptacle 39, and two side end points. The spring also has a plurality of attachment loops 93 disposed between the bottom of the spring and the top of the spring. Each of the spring attachment loops fits around the outside of a corresponding attachment stake 77. In the preferred embodiment, each attachment loop comprises a multilayer spring coil with a diameter greater than that of the corresponding attachment stake. The spring also has two spring guides 47. Each of the spring guides extends from the corresponding side end point of the top of the spring towards the corresponding spring attachment loop. The spring guides extend in a direction parallel to the door receptacle guides. The spring guides keep the door from moving sideways beyond the spring guides.

In the preferred embodiment and as shown in FIG. 9, the door receptacle 7 has a centrally disposed element 55 located between the two sides 63 of the door receptacle. The centrally disposed element has a lower edge 59 disposed above the bottom of the door receptacle 67. The door receptacle has a width smaller than the back housing 3; and each of the two door receptacle guides 71 extends from the bottom of the door receptacle towards the top of the door receptacle 39, at least as far as the lower edge of the centrally disposed element.

The door receptacle also has a plurality of stops 73 disposed on the interior surface of the centrally disposed element of the door receptacle. Each of the stops is located along the top of the door receptacle and extends a small distance from the top of the door receptacle towards the bottom of the door receptacle. At least one of the stops is in contact with and disposed underneath the straight segment of the spring located at the top of the spring 97. The stops ensure that a gap is maintained between the spring and the interior surface of the centrally disposed element and prevent the door from wedging against the door receptacle. In the preferred embodiment, the length of the straight segment of the top of the spring is parallel to the door extension 51. Also, the length of the straight segment of the top of the spring is less than the distance separating the attachment loops.

All such modifications and variations that may be apparent to a person skilled in the art are intended to be included within the scope of this invention.

What is claimed is:

1. A sliding door mechanism for a device including a device housing and a component, the device including a surface for placement of the device on a docking port, the docking including a connector for establishing data communications with the component, the sliding door mechanism comprising:

a door receptacle disposed on a portion of the device housing containing the component;

a door slideably coupled to the door receptacle, the door having a closed position wherein the door extends across at least a portion of the door receptacle and covers the component of the device, the door being slideable away from the bottom surface to an open position, the door in the open position exposing the device component to establish data communications with the docking port connector; and a spring coupled with the door to provide a spring force tending to keep the door in the closed position;

a plurality of attachment stakes disposed near the top of the door receptacle, each of the attachment stakes extending between a back of the housing towards a front of the housing; and wherein the spring includes a top and a bottom and further comprises a plurality of attachment loops fitting around the outside of the corresponding attachment stake, and two spring guides disposed between a top of the spring and a bottom of the spring, the spring guides keeping the door from moving sideways beyond the spring guides, each of the spring guides extending between a corresponding spring attachment loop and the top of the spring.

2. A sliding door mechanism for a device including a device housing and a component, the device including a surface for placement of the device on a docking port the docking port, including a connector for establishing data communications with the component, the sliding door mechanism comprising:

a door receptacle disposed on a portion of the device housing containing the component;

a door slideably coupled to the door receptacle, the door having a closed position wherein the door extends across at least a portion of the door receptacle and covers the component of the device, the door being slideable away from the bottom surface to an open position, the door in the open position exposing the device component to establish data communications with the docking port connector; and a spring coupled with the door to provide a spring force tending to keep the door in the closed position;

wherein the spring has a top and a bottom, the door receptacle has two sides, wherein the door receptacle further comprises:

a centrally disposed portion located between the two sides and having a lower edge disposed above the bottom of the door receptacle; and a plurality of stops disposed on an interior surface of the centrally disposed element of the door receptacle, each of the stops disposed along the top of the door receptacle and extending from the top of the door receptacle towards the bottom of the door receptacle, at least one of the stops in contact with and disposed underneath the top of the spring, and thereby maintaining a gap between the spring and the interior surface of the centrally disposed element and preventing the door from wedging against the door receptacle.

3. A portable device adapted for placement on a docking port, the portable device including a device housing and a component, the docking port including a connector for establishing data communications with the component:

the portable device adapted to operate a plurality of applications, each application capable of operating independently from the docking port connector, wherein data can be transmitted to the device for use with selected applications through data communications between the docking port connector and the component, the component adapted to transfer data from the portable device applications to the docking port for processing in the second device, and to receive data from the docking port for storage and processing in the portable device applications;

a door receptacle disposed on a portion of the device housing, the door receptacle having a bottom and a top containing the component;

a door having a closed position wherein the door extends across at least a portion of the door receptacle and covers the component of the device, and an open position wherein the door is provided sufficient clearance for the component to establish data communications through the docking port connector when the device is placed on the docking port, and a spring coupled with the door and the device, and having a spring force tending to keep the door in the closed position, and permitting the door to move to the open position in response to placement of the device on the docking port; wherein the device housing has a front, a back, and two sides;

a plurality of attachment stakes disposed near the top of the door receptacle, each of the attachment stakes extending from the back housing towards the front housing; wherein the spring has a top and a bottom and further comprises:

a plurality of attachment loops disposed between the bottom of the spring and the top of the spring, each of the attachment loops fitting around the outside of the corresponding attachment stake; and two spring guides disposed between the top of the spring and the bottom of the spring, each spring guide also disposed between a corresponding side of the door and a corresponding attachment stake, the spring guides keeping the door from moving sideways beyond the spring guides, each of the spring guides extending between a corresponding spring attachment loop and the top of the spring.

4. The portable device of claim 3, wherein the spring has a top and a bottom, the door receptacle has two sides and further comprises:

a centrally disposed element located between the two sides and having a lower edge disposed above the bottom of the door receptacle; and a plurality of stops disposed on an interior surface of the centrally disposed element of the door receptacle, each of the stops disposed along the top of the door receptacle and extending from the top of the door receptacle towards the bottom of the door receptacle, at least one of the stops in contact with and disposed underneath the top of the spring, and thereby maintaining a gap between the spring and the interior surface of the centrally disposed element and preventing the door from wedging against the door receptacle.

* * * * *